United States Patent [19]

Jenkins

[11] Patent Number: 4,735,144

[45] Date of Patent: Apr. 5, 1988

[54] DOCTOR BLADE AND HOLDER FOR METERING SYSTEM

[76] Inventor: Jerome D. Jenkins, 4749 N. 118 St., Wauwatosa, Wis. 53225

[21] Appl. No.: 865,279

[22] Filed: May 21, 1986

[51] Int. Cl.[4] ..... B41F 31/02

[52] U.S. Cl. ..... 101/464; 101/425; 15/256.51; 118/413; 118/261

[58] Field of Search ..... 101/425, 364, 367, 350, 101/363, 169, 157, 161, 204; 15/256.51; 428/113; 264/117; 427/195; 30/169; 252/12; 118/413, 261

[56] References Cited

U.S. PATENT DOCUMENTS

| | | | |
|---|---|---|---|
| 2,525,363 | 10/1950 | Luehrs | 101/364 |
| 2,794,405 | 6/1957 | Vogt | 15/256.57 |
| 2,920,558 | 1/1960 | Hewlett | 101/364 |
| 2,929,321 | 3/1960 | Newbegin | 101/364 |
| 3,016,826 | 1/1962 | Sage | 101/425 |
| 3,052,183 | 9/1962 | Zernov et al. | 101/364 X |
| 3,067,056 | 12/1962 | Remer | 101/364 |
| 3,097,968 | 7/1963 | Schaefer | 101/364 X |
| 3,135,197 | 6/1964 | Dutro et al. | 101/364 |
| 3,150,002 | 9/1964 | Justus | 101/425 |
| 3,155,037 | 11/1964 | Haskin, Jr. | 101/364 |
| 3,164,087 | 1/1965 | Owen | 101/425 |
| 3,405,683 | 10/1968 | Jons et al. | 101/425 X |
| 3,835,779 | 9/1974 | Ross et al. | 101/425 |
| 3,869,344 | 3/1975 | Hunt | 15/256.57 |
| 4,080,735 | 3/1978 | Michalski | 30/169 X |
| 4,143,110 | 3/1979 | Morozumi et al. | 264/117 |
| 4,147,819 | 3/1979 | Hukumoto et al. | 427/195 |
| 4,151,797 | 5/1979 | Dunsirn | 101/425 X |
| 4,414,900 | 11/1983 | Kraus et al. | 101/363 |
| 4,549,933 | 10/1985 | Judd et al. | 15/256.51 |
| 4,575,430 | 3/1986 | Periard et al. | 252/12 |

FOREIGN PATENT DOCUMENTS

| | | | |
|---|---|---|---|
| 71180 | 2/1983 | European Pat. Off. | 101/364 |
| 604568 | 7/1948 | United Kingdom | 101/364 |
| 895125 | 5/1962 | United Kingdom | 101/425 |

*Primary Examiner*—E. H. Eickholt

*Attorney, Agent, or Firm*—Finnegan, Henderson, Farabow, Garrett & Dunner

[57] ABSTRACT

An ink metering system for a rotating ink roll having a shaft journalled in the frame of a inking system includes two doctor blades and a mechanism for supporting the doctor blades on the shaft of the ink roll so that the doctor blades contact the ink roll under uniform pressure independent of movement between the ink roll and the frame. The arrangement also includes a mechanism for adjusting the pressure of the doctor blades and for sealing the system. The doctor blade is composed of polytetrafluoroethylene-polyphenylene sulfide ceramic resin containing graphite fibers. The doctor blade includes a number of laminated sheets of this material in which a majority of the sheets include fibers oriented in the machine direction and at least one sheet includes fibers oriented perpendicular to the machine direction.

23 Claims, 3 Drawing Sheets

DOCTOR BLADE AND HOLDER FOR METERING SYSTEM

BACKGROUND OF THE INVENTION

The invention relates generally to ink and coating material metering systems. Most metering systems can be classified in one of five general categories.

FIG. 1 shows a two-roll ink metering system having an elastomeric fountain roll, an applicator roll, and an ink transfer roll. A plate roll cylinder and impression cylinder complete the printing or coating station. The latter two cylinders are not part of the ink metering system and can be changed to a single roll if a plate roll is not needed.

FIG. 2 shows a regular-angle doctor blade system where an ink transfer roll is immersed in a fountain of ink as the ink transfer roll carries up the ink. A doctor blade is positioned at an acute angle toward the unmetered ink to smooth the ink off the ink transfer roll.

FIG. 3 shows a reverse-angle doctor blade system where an ink transfer roll is immersed in a fountain of ink. A doctor blade is positioned at an obtuse angle toward the unmetered ink so that ink is sheared off the ink transfer roll as the ink transfer roll carries up the ink.

FIG. 4 shows a combination system where a fountain roll acts as an applicator roll and does a certain amount of initial metering. The final metering is usually accomplished by a reverse-angle doctor blade rather than a regular-angle blade.

FIG. 5 shows a dual doctor blade system where the ink is pumped into a cavity between two doctor blades. One doctor blade is a regular-angle doctor blade, and the other is a reverse-angle doctor blade. The system can be used in either rotation direction. The cavity is kept under slight pressure. The blade holder is attached to the press frame and can be moved to control blade pressure and cleanup.

The two-roll system has a fountain roll which is usually Buna N, a synthetic rubber, and an engraved ink transfer roll. The engraved roll contains a number of cavities per lineal inch. The fountain roll supplies ink to the cavities, which prevent ink squeeze-out. The desire to print the fine line screens of tone and process work and thinner coating thickness brought about the development of a new series of engraved rolls. Ceramic coated and laser engraved rolls are the latest development. Such rolls give long repeatable results, high cavities count and randomly placed cavities which eliminate the interference patterns referred to as moires, often developed when printing the fine line screen with a conventional pyramidal mechanically engraved roll.

A differential ink metering system was devised in an attempt to run at higher speeds without slinging ink. The fountain roll was slowed down in relation to the speed of the ink transfer roll for non-differential ink metering. In addition to curtailing the ink slinging problem, the system proved to have several other advantages. The definite wiping action improved the metering. Also, when using an engraved roll, the fountain roll wiping action forced ink into the cavities under pressure which helped to fill the cavities. The main drawback to this system is that the quantities of ink or coating delivered are a function of speed. As the speed of the fountain roll increases, the hydraulic pressure of the ink or coating increases, depressing the rubber fountain roll and allowing more ink to pass through the nip between the fountain roll and the ink transfer roll.

In the regular-angle doctor blade system, the metering action is similar to the differential systems in that the metal blade is deflected upward at greater speeds and, consequently, greater hydraulic ink pressures. In many systems, the angle of the blade to the engraved cylinder can be varied to obtain optimum metering conditions.

In the reverse-angle doctor blade system, the doctor blade is at an obtuse angle toward the ink supply. The blade supplies a shearing action which cleans excess ink from the ink transfer roll. Larger particles are deflected by the blade. The hydraulic pressures of the ink push the blade into the engraved roller. At higher speeds the ink transfer is just about the same as it is at slower speeds. The metal blade causes greater wear to the engraved transfer roll, especially at higher press speeds, due to hydraulic pressure of the ink pushing the blade into the engraved roll making metal-to-metal contact. This wear has been found to be less at some blade angles. Also, some different blade materials have been found preferable. Most systems are Swedish clockspring steel, although several plastics have been used at varying degrees of success when rusting of metal blades is a problem. The plastics previously used have been nylon, epoxy, and polyester. In general, these blades wear much faster than the steel. Most plastic swells and eventually deteriorates in the presence of solvent and causes the blade not to stay in contact with the engraved roll.

In doctor blade systems where the transfer roll is immersed in ink, starvation can occur at higher speeds. The combination doctor blade/fountain roll system solves the starvation problem, but has not eliminated the hydraulic effect at high speed. It also adds cost to the system and increases power usage.

The dual blade system solved most of the problems associated with the other systems. It maintains proper ink volume at all press speeds, reduces solvent loss, prevents contamination of the ink, reduces ink starvation because the cavity is pressurized, and eliminates the use of the rubber fountain roll. Due to the complicated mechanism of the holder and its being attached to a press frame that is not always rigid, the blades have often experienced differing or excessive pressure resulting in rapid wear.

A deterioration of a doctor blade surface occurs because of the wiping action on the engraved cylinder. Generally, doctor blades exhibit two basic types of wear which may be classified as adhesive wear and abrasive wear. Adhesive wear is caused by the shearing action of micro-contacts formed between two surface asperities that actually carry the load between the blade and the cylinder. This type of wear occurs because of the break in continuity of the ink or coating film which should separate the two surfaces.

Abrasive or cutting type of wear takes place whenever hard, foreign particles are present between the rubbing surfaces. Depending upon severity, abrasive wear may be of a gouging or scratching form on the cylinder. However, abrasive wear has virtually been eliminated by the development of the ceramic coated and laser engraved metering cylinder.

Adhesive wear of the blades is controlled by the lubrication properties of the ink, cylinder surface finish and working pressure of the blade resulting from the adjustment force. When the lubrication film separating two surfaces is interrupted, blade to cylinder contact strongly accentuates the blade wear. This phenomenon is caused by insufficient fluid or high blade pressure which creates an insufficient bearing effect.

Accordingly, it an object of the present invention to solve the problems of wear, ink and coating slinging, and lack of uniform metering due to the drawbacks of conventional ink metering systems described above.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

SUMMARY OF THE INVENTION

To achieve the foregoing objects, and in accordance with the purposes of the invention as embodied and broadly described herein, there is provided an ink metering system for a rotating ink roll having a shaft journalled in the frame of an inking system. The ink metering system comprises a first doctor blade, and means for supporting the first doctor blade on the shaft of the ink roll so that the first doctor blade contacts the ink roll at a uniform pressure independent of relative movement between the ink roll and the frame.

There is also provided means for contacting the ink roll at a position spaced from the first doctor blade, the contacting means supported by the supporting means, and wherein the first doctor blade, the contacting means and the supporting means form housing means surrounding a portion of the ink roll for containing ink.

There is also provided a doctor blade comprising a plurality of laminated sheets including a material composed of polytetrafluoroethylene-polyphenylene sulfide ceramic resin containing graphite fibers oriented in the machine direction.

The accompanying drawings, which are incorporated in and constitute a part of the specification, illustrate a preferred embodiment of the invention and, together with the general description given above and the detailed description of the preferred embodiment given below, serve to explain the principles of the invention.

DESCRIPTION OF THE PREFERRED EMBODIMENT

Reference will now be made in detail to the present preferred embodiment of the invention as illustrated in the accompanying drawings.

In accordance with the present invention, there is provided an ink metering system for a rotating ink roll having a shaft journaled in the frame of an inking system, the ink metering system comprising a first doctor blade, and means for supporting the first doctor blade on the shaft of the ink roll so that the first doctor blade contacts the ink roll at a uniform pressure independent of relative movement between the ink roll and the frame.

Figure 1:
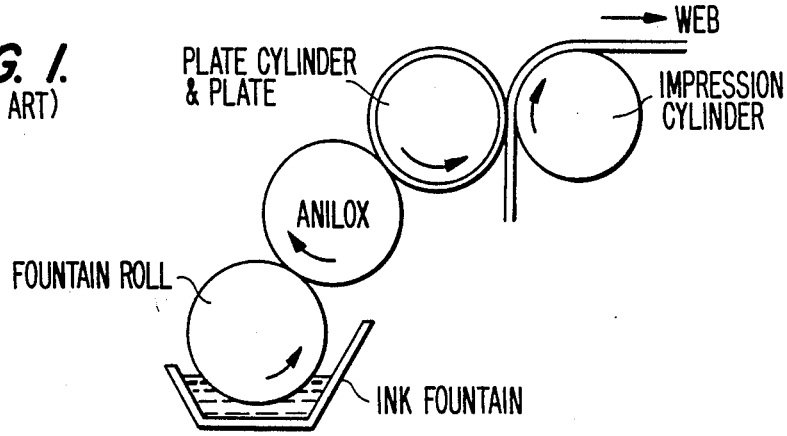
FIG. 1. (PRIOR ART)
FIG. 1 is a schematic view of a conventional two-roll ink metering system.
Figure 2:
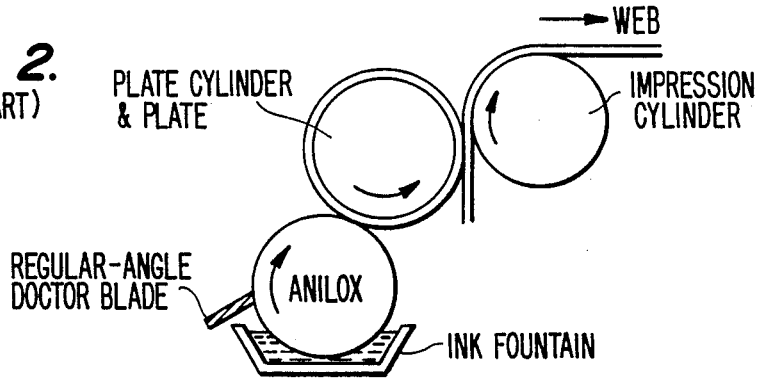
FIG. 2. (PRIOR ART)
FIG. 2 is a schematic view of a conventional regular-angle doctor blade system.
Figure 3:
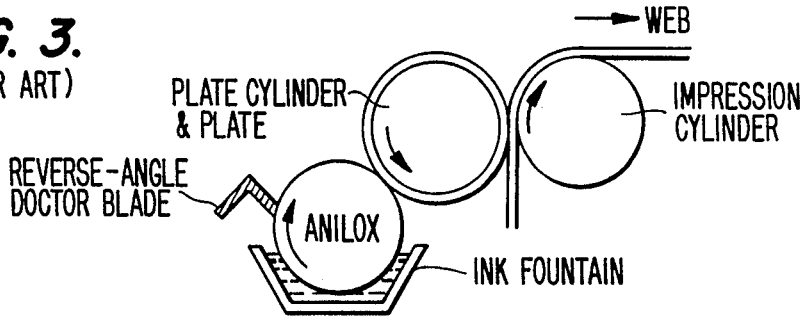
FIG. 3. (PRIOR ART)
FIG. 3 is a schematic view of a conventional reverse-angle doctor blade system.
Figure 4:
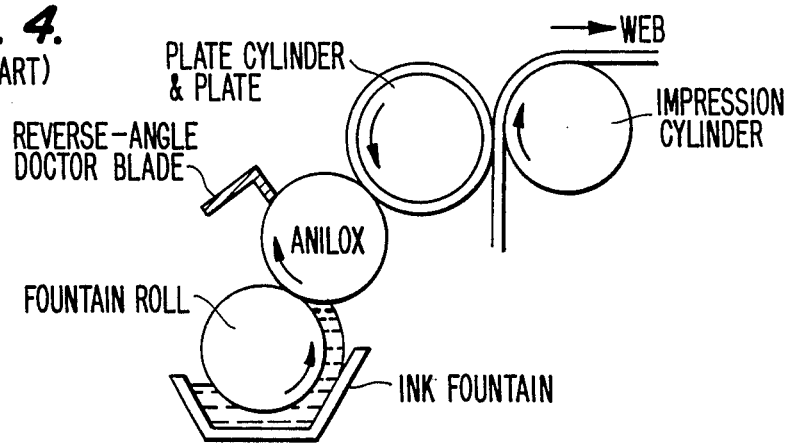
FIG. 4. (PRIOR ART)
FIG. 4 is a schematic view of a conventional combination doctor blade system.
Figure 7:
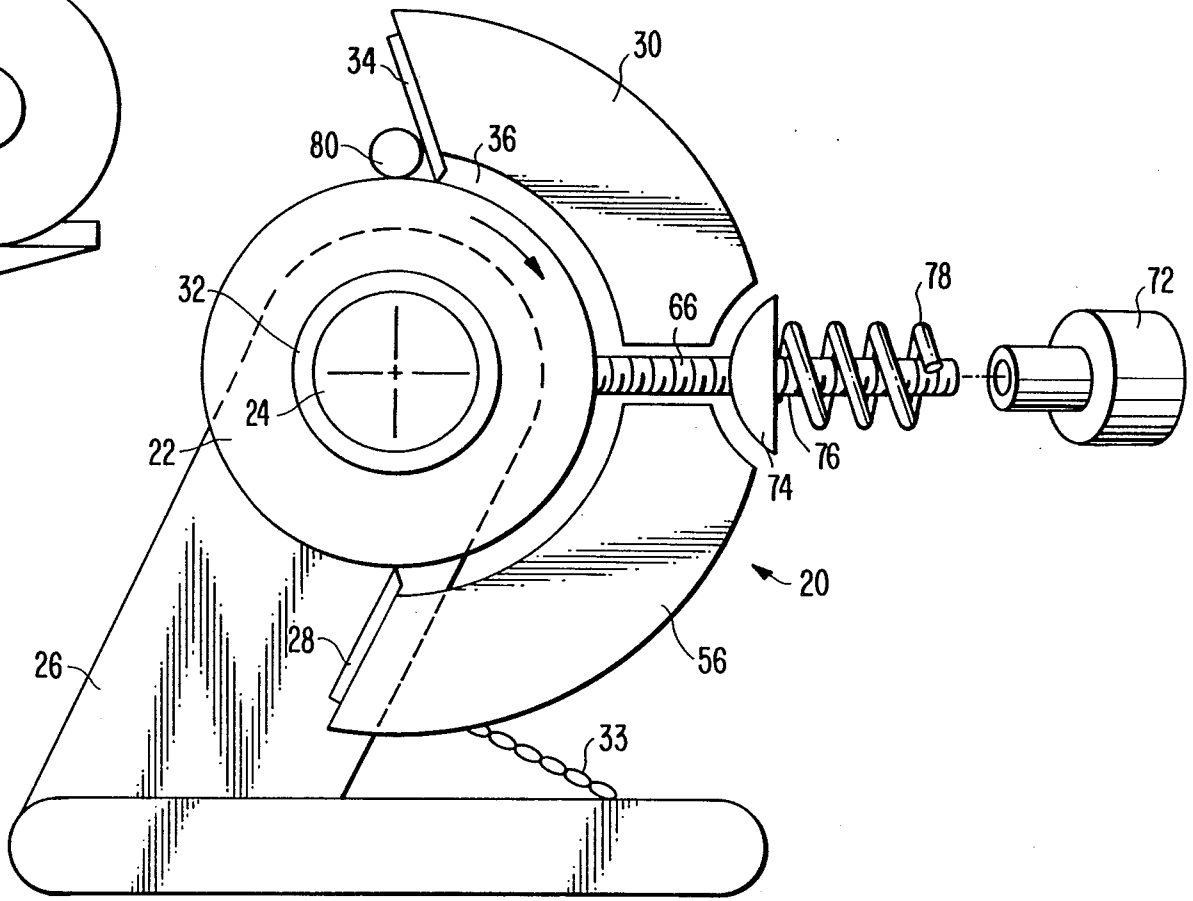
FIG. 7 is an end view of the arrangement shown in FIG. 6.
Figure 5:
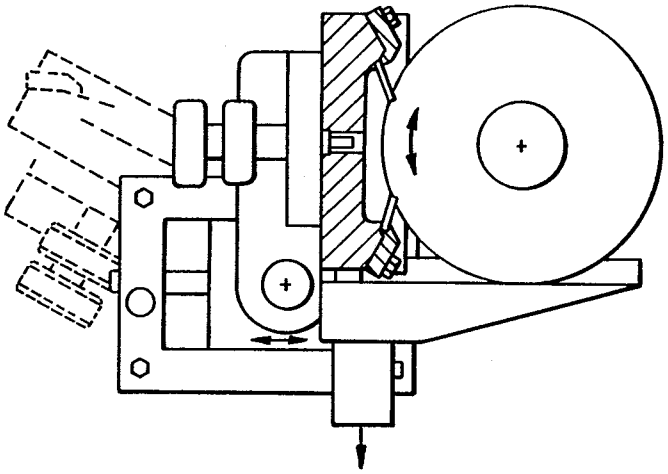
FIG. 5. (PRIOR ART)
FIG. 5 is a schematic view of a conventional dual doctor blade system.

As embodied herein, and as shown in FIG. 7, there is provided an ink metering system 20 for a rotating ink roll 22 on a shaft 24 journaled in the frame 26 of a printing or coating system. As shown in FIG. 7, roll 22 rotates in the clockwise direction. Frame 26 is stationary. A first doctor blade 28 is positioned along the axial length of roll 22. Means for supporting the first doctor blade 28 on the shaft of the ink roll includes tubular mounting plate 30 on which first doctor blade 28 is mounted and bearing 32 by which tubular mounting plate 30 is mounted on the shaft 24 of roll 22. A second bearing 32 is positioned at the opposite end of shaft 24. The doctor blade 28 and tubular mounting plate 30 are prevented from rotating relative to the frame 26 by a flexible element such as chain 33 which is anchored to frame 26. The components of the ink metering system 20 are shown in an exploded view in FIG. 6.

According to the present invention, the ink metering system includes means for contacting the ink roll at a position spaced from the first doctor blade, the contacting means supported by the supporting means, wherein the first doctor blade, the contacting means and the supporting means form housing means surrounding a portion of the ink roll for containing ink.

As embodied herein and as shown in FIG. 7, the means for contacting the ink roll 22 at a position spaced from the first doctor blade 28 is a second doctor blade 34. In such a manner, it is seen that the first doctor blade 28, the contacting means such as second doctor blade 34, and the supporting means such as tubular mounting plate 30, form a housing means surrounding a portion of the ink roll 22 for containing ink in a cavity 36 formed between the housing means and the ink roll 22. The tubular shaped wrap-around mounting plate 30 covering almost half the circumference of the ink roll 22 gives increased wetted area and improves the rigidity of the assembly.

According to the present invention, the first doctor blade is mounted at an angle of about 30° from a tangent line of the ink roll in the direction of rotation. Also, in accordance with the present invention, the second doctor blade is mounted at an angle of about 30° from a tangent line of the ink roll opposite the direction of rotation.

Figure 6:
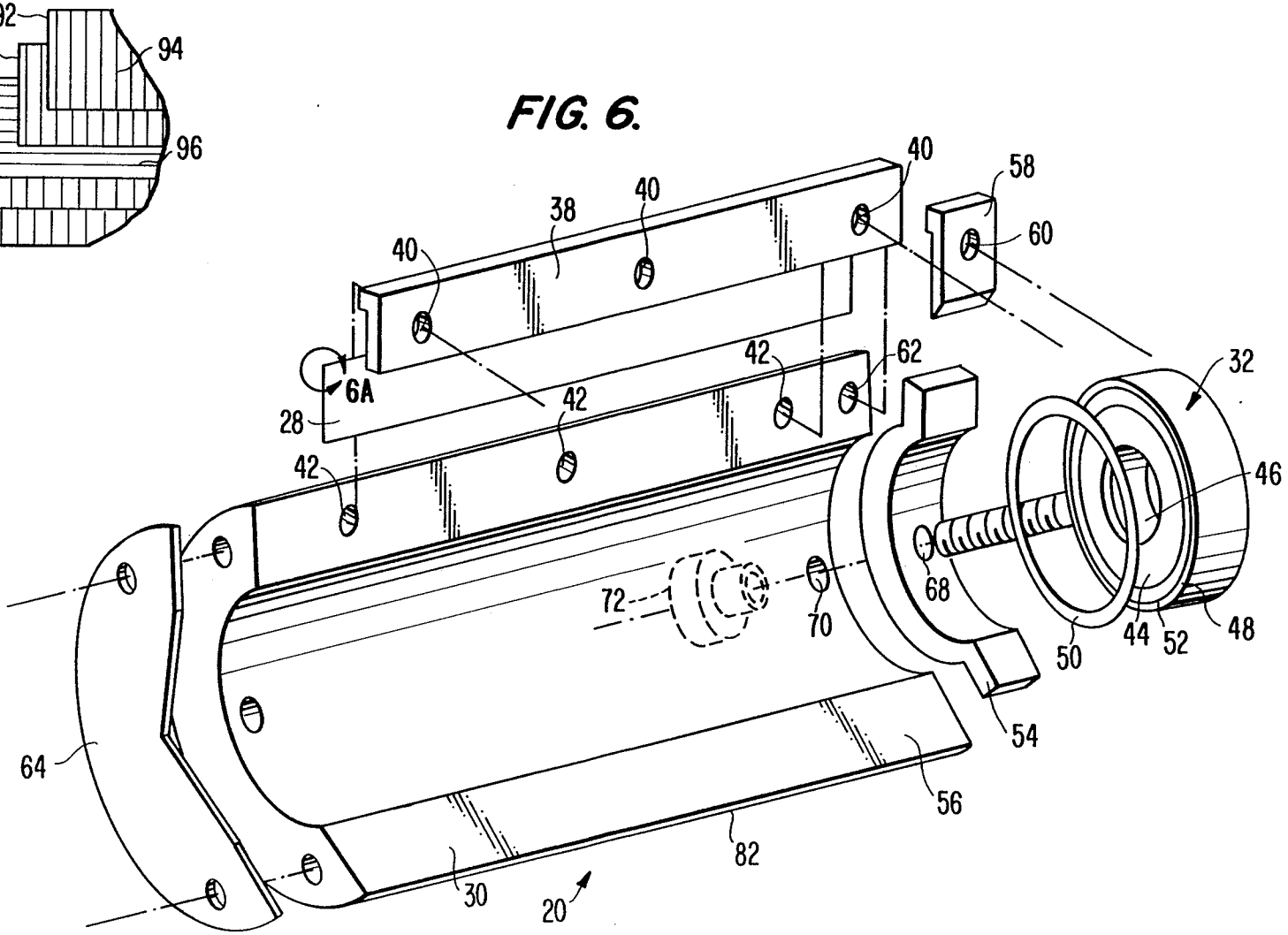
FIG. 6 is an exploded perspective view of a doctor blade and holder for an ink metering system according to the teachings of the present invention.
Figure 6A:
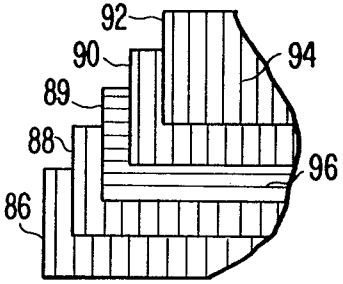
FIG. 6A is a detail view of the doctor blade of FIG. 6.

The angular positioning of doctor blades 28 and 34 is shown in FIG. 7. As shown in FIG. 6, doctor blade 28 is mounted to tubular mounting plate 30 by clamping plate arrangement 38 through the use of threaded fasteners (not shown) which pass through holes 40 in plate 38 and are anchored in holes 42 in tubular mounting plate 30.

In accordance with the present invention, the supporting means includes inner bearing elements mounted on and sealed to the shaft at each end of the ink roll to rotate with the shaft; and outer bearing elements paired with, rotatable relative to, and sealed to the inner bearing elements.

As embodied herein and shown in FIG. 6, bearing 32 includes inner bearing element 44 containing aperture 46 which fits over the shaft 24 (shown in FIG. 7) of the ink roll 22 and is mounted on the shaft 22 by a set screw (not shown) or another method of fastening. A sealant is provided to fill any gap between shaft 24 and inner bearing element 44.

An outer bearing element 48 is paired with inner bearing element 44 and is rotatable relative to inner bearing element 44 so that outer bearing element 48 may be held stationary as inner bearing element 44 rotates with shaft 24.

In accordance with the present invention, face seal means are used for sealing each pair of inner and outer bearing elements together. Each face seal means is interposed and held in place on one face by an axial end of the ink roll and on the other face by an axial portion of a pair of inner and outer bearing elements.

As embodied herein and as shown in FIG. 6, the face seal means includes an annular plate shaped seal member 50 having two axially facing faces. The face on the near side of seal member 50 is held in place by an axial end of the ink roll 22 and on the other face by an axial portion of the pair of inner and outer bearing elements 32 at their interface 52.

In accordance with the present invention, the supporting means includes a compressible member mounted between the doctor blade and the shaft. The supporting means further includes an outer shell on which the first doctor blade is mounted and the compressible member is mounted between the outer shell and the outer bearing elements.

As embodied herein and as shown in FIG. 6, a pair of compressible members 54 (only one being shown) are mounted between a rigid outer shell 56 of mounting plate 30 and outer bearing element 48 of the respective bearing 32. Compressible member 54 can be composed of polyethlene, polypropylene, or other suitable foams. A clamping plate 58 is used to hold compressible member 54 in place. A threaded fastener (not shown) passes through hole 60 and is anchored in hole 62. End plates 64 are also employed at each end of tubular mounting plate 30 to keep the compressible members 54 in place.

In accordance with the present invention, there is provided means for adjusting the pressure of the first doctor blade against the ink roll. In further accordance with the present invention the adjusting means includes a pair of screws, each of the screws having one end anchored in a respective outer bearing element, an intermediate portion of the screw passing through the compressible member in the outer shell, and an adjustment knob means mounted on the other end of the screw and rotatable for varying the pressure of the first doctor blade against the ink roll by varying the pressure exerted against the outer shell by the adjustment knob.

As embodied herein and shown in FIG. 7, the adjusting means includes a screw 66 at each end of the tubular mounting plate 30. Screw 66 is anchored in outer bearing element 48 as best shown in FIG. 6. Screw 66 passes through a hole 68 in compressible member 54 and through a hole 70 in outer shell 56. An adjustment knob 72 is mounted on the other end of screw 66 and is rotatable for varying the radial distance between the outer shell 56 and the bearing element 32.

In accordance with the present invention, there is provided a spherical bearing between each adjustment knob and the outer shell and each spherical bearing includes a spherical bearing plate positioned against the outer shell and a spring between each adjustment knob and respective spherical bearing. As shown in FIG. 7, spherical bearing plate 74 is mounted on screw 66 through hole 76. Outer shell 56 includes a spherical bearing surface complementing spherical bearing plate 74. A spring such as coil spring 78 biases the arrangement so that the spherical bearing plate 74 presses against outer shell 56 and doctor blades 28 and 34 press against ink roll 22.

As shown in FIG. 7 there is a three point contact on the ink roll assembly formed by the two doctor blades and the screws. This allows uniform blade pressure to be exerted by both blades regardless of how the blade pressure is adjusted and allows pressure to be maintained across the entire face of the blade no matter what length metering roll is used.

In accordance with the present invention, there is provided a vacuum manifold means proximate to, and upstream of, the location where the contacting means contacts the ink roll. As embodied herein and shown in FIG. 7, vacuum manifold means includes a tubular vacuum manifold 80 extending along the trailing second doctor blade 34 to remove contamination that builds up on this blade resulting from the printing of dirty substrates or the buildup of dried ink on components in proximity to this assembly that flake off and get onto the surface of ink roll 22. Vacuum manifold 80 also removes any fugitive fumes that exist on the surface of ink roll 22 while it is being exposed to the atmosphere.

In accordance with the present invention, the doctor blades and the support means are coated with a high release material. As shown in FIG. 6, a Teflon coating 82 covers the entire assemble for ease and cleaning.

The blade holder arrangement of the present invention allows the doctor blades to be firmly and rigidly held in place while the ink roll is rotating. This maintains uniform pressure along the blade despite displacements of the ink roll from its normal position relative to the frame in which it rotates. The seals of the blade holder keep the fluid from contacting the bearings in the system and prevent slinging of ink.

In accordance with the present invention, there is provided a doctor blade comprising a material composed of a resinous material containing fibers oriented in the machine direction, that is, in the tangential direction relative to the ink roll. In further accordance with the invention, the resinous material comprises a material composed of polytetrafluoroethylene-polyphenylene sulfide and the fibers in the blade are unidirectional in arrangement and are composed of graphite. In further accordance with the present invention, the doctor blade comprises a plurality of laminated sheets of resinous material in which a majority of the sheets include fibers oriented in the machine direction and at least one sheet includes fibers oriented perpendicular to the machine direction.

As embodied herein and as shown in the magnified, exploded portion of FIG. 6 designated by numeral 84, five sheets 86, 88, 89, 90, 92 of a material composed of polytetrafluoroethylene-polyphenylene sulfide are laminated together. The two outside sheets on each side 86, 88, and 90, 92 contain graphite fibers 94 oriented in the machine direction and the middle sheet 89 includes graphite fibers 96 oriented perpendicular to the machine direction.

This construction of the doctor blade provides a non-metallic blade that is compatible with an extremely wide variety of inks and fluids used by inking systems. The doctor blade has a very high stiffness in the machine direction and is no more than about 0.025 inches in thickness. It has high lubricating properties when the fluid film is lost or interrupted.

The use of a polytetrafluoroethylene-polyphenylene sulfide ceramic resin allows all components of the blade to have no known solvents below 400° F. With the individually good physical properties of polyphenylene sulfide resin, polytetrafluoroethylene and a graphite reinforcing filler, there is provided a blade construction having low friction and an excellent balance of physical properties including compressive strength.

In accordance with the present invention, the blade material comprises a ceramic resin. It is preferably in the form of a fibrous material when used with a ceramic coated ink roll. With other ink roll coatings, it is preferably a spherical form which is spherodized by passing powder through a plasma arc heat source.

Additional advantages and modifications will readily occur to those skilled in the art. The invention in its broader aspects is, therefore, not limited to the specific details, representative apparatus and illustrative example shown and described. Accordingly, departures may be made from such details without departing from the spirit or scope of the general inventive concept as defined by the appended claims and their equivalents.

What is claimed is:

1. An ink metering system for a rotating ink roll having a shaft journalled in the frame of an inking system, the ink metering system comprising:

a first doctor blade;

means for supporting the first doctor blade on the shaft of the ink roll so that the first doctor blade contacts the ink roll at a uniform pressure independent of relative movement between the ink roll and the frame, the supporting means including inner bearing elements mounted on and sealed to the shaft at each end of the ink roll to rotate with the shaft and outer bearing elements paired with, rotatable relative to, and sealed to the inner bearing elements; and means for contacting the ink roll at a position spaced from the first doctor blade, the contacting means supported by the supporting means, wherein the first doctor blade, the contacting means, and the supporting means form housing means surrounding a portion of the ink roll for containing ink between the housing means and the ink roll.

2. The system of claim 1 wherein the contacting means is a second doctor blade.

3. The system of claim 1 wherein the first doctor blade is mounted at an angle of about 30° from a tangent line of the ink roll in the direction of rotation.

4. The system of claim, 2 wherein the second doctor blade is mounted at an angle of about 30° from a tangent line of the roll opposite the direction of rotation.

5. The system of claim 1 including face seal means for sealing each pair of inner and outer bearing elements together.

6. The system of claim 5 wherein each face seal means is interposed and held in place on one face by an axial end of the ink roll and on the other face by an axial portion of a pair of the inner and outer bearing elements.

7. The system of claim 1 wherein the supporting means includes a compressible member mounted between the doctor blade and the shaft.

8. The system of claim 1 wherein the supporting means includes an outer shell on which the first doctor blade is mounted and a compressible member mounted between the outer shell and the outer bearing elements.

9. The system of claim 7 including means for adjusting the pressure of the first doctor blade against the ink roll.

10. The system of claim 8 including means for adjusting the pressure of the first doctor blade against the ink roll.

11. The system of claim 10 wherein the adjusting means includes a pair of screws, each screw having one end anchored in a respective outer bearing elements, an intermediate portion of the screw passing through the compressible member and the outer shell; and an adjustment knob means mounted on the other end of the screw and rotatable for varying the pressure of the first doctor blade against the ink roll by varying the pressure exerted against the outer shell by the adjustment knob.

12. The system of claim 11 including a spherical bearing between each adjustment knob and the outer shell.

13. The system of claim 12 including wherein each spherical bearing includes a spherical bearing plate positioned against the outer shell and a spring between each adjustment knob and respective spherical bearing plate.

14. The system of claim 1 including vacuum manifold means proximate to and upstream of the location where the contacting means contacts the ink roll.

15. The system of claim 1 wherein the first doctor blade and supporting means is coated with a high release material.

16. The system of claim 1 wherein the first doctor blade is formed from a resinous material containing fibers oriented substantially orthogonal to the shaft of the ink roll.

17. The system of claim 16 wherein the fibers comprise graphite.

18. The system of claim 16 wherein the resinous material comprises polytetrafluoroethylene-polyphenylene sulfide.

19. The system of claim 18 wherein the resinous material comprises a ceramic resin.

20. The system of claim 1 wherein the first doctor blade comprises a plurality of laminated sheets of resinous material.

21. The system of claim 20 wherein at least one of the sheets includes fibers oriented substantially orthogonal to the shaft of the ink roll.

22. The system of claim 21 wherein a majority of the sheets includes fibers oriented substantially orthogonal to the shaft of the ink roll.

23. The system of claim 22 wherein at least one sheet includes fibers oriented substantially parallel to the shaft of the ink roll.

* * * * *

Notice of Adverse Decision in Inteference

In Interference No. 102,220, involving Patent No. 4,735,144, J. D. Jenkins, DOCTOR BLADE AND HOLDER FOR METERING SYSTEM, final judgment adverse to the patentee was rendered Feb. 6, 1990, as to claims 1-23.

( *Official Gazette May 8, 1990* )